US007845197B2

(12) United States Patent
Frushtick

(10) Patent No.: US 7,845,197 B2
(45) **Date of Patent: *Dec. 7, 2010**

(54) TRIPLE PASS TUNNEL FINISHER WITH AN ARTICULATED SPRAYING FUNCTION

(75) Inventor: Jeffrey Neal Frushtick, Denver, NC (US)

(73) Assignee: Leonard Automatics, Inc., Denver, NC (US)

( * ) Notice: Subject to any disclaimer, the term of this patent is extended or adjusted under 35 U.S.C. 154(b) by 1012 days.

This patent is subject to a terminal disclaimer.

(21) Appl. No.: 11/612,752

(22) Filed: Dec. 19, 2006

(65) Prior Publication Data

US 2007/0101623 A1 May 10, 2007

Related U.S. Application Data

(63) Continuation-in-part of application No. 11/421,247, filed on May 31, 2006.

(60) Provisional application No. 60/597,743, filed on Dec. 19, 2005, provisional application No. 60/685,900, filed on May 31, 2005.

(51) Int. Cl.
*D06B 3/30* (2006.01)

(52) U.S. Cl. ..... 68/5 C; 68/5 E; 68/20; 8/149.1; 8/149.2; 8/149.3; 34/216; 34/218; 38/1 R; 38/14

(58) Field of Classification Search ..... 68/3 R, 68/5 C, 5 D, 5 E, 10, 20, 205 R; 8/148, 149, 8/149.1, 149.2, 149.3; 34/134, 216, 218, 34/376, 389, 621; 38/1 R, 14, 7, 82
See application file for complete search history.

(56) References Cited

U.S. PATENT DOCUMENTS

| | | | | | |
|---|---|---|---|---|---|
| 3,644,085 | A | * | 2/1972 | Beeley et al. | 8/150 |
| 3,686,899 | A | | 8/1972 | Rosenfeld et al. | |
| 3,696,523 | A | * | 10/1972 | Beeley et al. | 34/216 |
| 3,732,628 | A | * | 5/1973 | Blevens et al. | 34/389 |
| 4,032,294 | A | * | 6/1977 | Thompson et al. | 8/116.4 |
| 4,070,876 | A | * | 1/1978 | Thompson et al. | 68/3 R |
| 4,304,053 | A | * | 12/1981 | Kellerhals et al. | 34/621 |
| 5,018,371 | A | | 5/1991 | Riba | |
| 5,046,335 | A | * | 9/1991 | Riba | 68/5 C |

(Continued)

OTHER PUBLICATIONS

Exhibit A, 1 Pg., Apr. 2007.

*Primary Examiner*—Joseph L Perrin
*Assistant Examiner*—Benjamin Osterhout
(74) *Attorney, Agent, or Firm*—Adams Intellectual Property Law

(57) ABSTRACT

A high efficiency triple pass tunnel finisher includes an articulated spraying function for allowing steam to effectively penetrate a garment. The tunnel finisher can be used for the laundering of shirts, pants, and jackets. The tunnel finisher includes hot air chambers and a steam chamber that can include two rows of steam injectors located at a 45° angle in relation to the walls of the module. The steam chamber has a lower pressure than the hot air chambers, creating an air pressure differential. The hot air chambers are positively pressurized, preventing the relatively cooler air of the steam chamber from entering the chamber. The pressurization prevents heat loss, allowing the finisher to be more efficient, while increasing the temperature at which the garments exit the steam chamber. This leads to faster drying times, less garment wrinkling, and reduced dwell time for a garment with a high quality appearance.

9 Claims, 6 Drawing Sheets

U.S. PATENT DOCUMENTS 5,276,978 A 1/1994 Hopkins et al.
5,459,301 A 10/1995 Miller et al.
5,651,192 A 7/1997 Horwitz
6,311,526 B1 11/2001 Frushtick

* cited by examiner

TRIPLE PASS TUNNEL FINISHER WITH AN ARTICULATED SPRAYING FUNCTION

This application is a continuation-in-part of U.S. application Ser. No. 11/421,247 filed May 31, 2006, which claims priority to U.S. Provisional Application No. 60/685,900 filed May 31, 2005. This application also claims priority to U.S. Provisional Application No. 60/597,743 filed Dec. 19, 2005.

TECHNICAL FIELD AND BACKGROUND OF THE INVENTION

This invention relates to a high efficiency triple pass tunnel finisher with an articulated spraying function. Tunnel finishers are used to remove wrinkles, which are set into garments during the laundry process. In many cases, they are also used to dry and remove wrinkles from the garments after laundering.

Conventional tunnel finishers are commonly referred to as a "straight-through" or "U-turn" tunnel finisher based on their shape. In a "straight-through" finisher, damp garments on a hanger enter one end, and pass in a straight line through the finisher, exiting on the other end. In a "U-turn" finisher, damp garments on a hanger enter and exit on the same end of the finisher, making a U-turn at the opposite end.

A tunnel finisher finishes a garment by subjecting the garment to a steaming zone and a hot air zone. In the steaming zone, a garment is conditioned with live steam injection before it proceeds to the hot air zone. In the hot air zone, the garment is heated and agitated with hot air to evaporate moisture from the garment. This process causes the fibers in the garment to return to their natural, relaxed, wrinkle free condition.

The efficiency of a tunnel finisher and the quality of the appearance of the garment after processing is dependent on the dwell time of the garment inside the machine. The garment must remain in the finisher for a length of time sufficient to permit the temperature of the garment to be raised to a predetermined optimum temperature, typically 280° F., well above the evaporation point of water, so that the remaining moisture in the garment is evaporated. In conventional garment finishers, the temperature of the garments typically reach about 160° F. in the steam chamber, and then the temperature must be raised in a subsequent chamber to the desired temperature of about 280° F. In conventional garment finishers, cooler air from outside the finisher is typically drafted into the steam chamber, and the cooler air of the steam chamber is drafted into the subsequent finishing chamber. This has the undesirable effect of lowering the temperature in the steam chamber and finishing chamber, resulting in less efficiency as the finishing chamber must expend more energy to reach the desired optimum temperature, and more time is required for the garments to have the necessary dwell time at the optimum temperature in the finisher.

Some conventional tunnel finishers include all of the functioning elements necessary for the operation of the finisher in a single cabinet. As such, laundries need to purchase a finisher with a capacity large enough to handle present production levels as well as production increases over a long period of time. Most tunnel finishers are manufactured in such a manner that when production levels increase, a new finisher must be purchased. Other tunnel finishers can be expanded by adding modules, however, the expansion modules must include blowers, burners, gas trains, flame-control systems and other relatively expensive features of the finisher.

SUMMARY OF THE INVENTION

Therefore, it is an object of the invention to provide a triple pass tunnel finisher that minimizes the amount of cool air that is drafted into the finisher.

It is another object of the invention to provide a triple pass tunnel finisher with an expanded steam injection chamber.

It is another object of the invention to provide a triple pass tunnel finisher that allows steam to effectively penetrate the garment.

These and other objectives of the invention are achieved in the preferred embodiments of the invention disclosed below, by providing a tunnel fabric finishing apparatus having a steam injection chamber for receiving and treating fabric pieces with steam, and at least one hot air chamber in downstream communication with the steam injection chamber for directing hot air at the treated fabric pieces, in which the hot air chamber is positively pressurized to prevent entry of cooler air from the steam injection chamber.

According to another preferred embodiment of the invention, the finisher includes two hot air chambers that provide substantially equal air flow in each of the chambers.

According to yet another preferred embodiment of the invention, the steam injection chamber includes a flow path on which the fabric pieces move from an entrance to the steam injection chamber to an exit from the steam injection chamber. In addition, the steam injection chamber includes at least one steam injector positioned at a non-perpendicular angle relative to the flow path such that the steam injector directs a spray of steam impacting a major surface of the fabric pieces.

According to another preferred embodiment of the invention, the steam injector is positioned at an angle of about forty-five degrees relative to the at least one wall of the steam injection chamber.

According to another preferred embodiment of the invention, the steam injection chamber includes a flow path on which the fabric pieces move from an entrance to the steam injection chamber to an exit from the steam injection chamber, and the steam injection chamber includes a first steam injector array positioned proximate the entrance of the chamber at a non-perpendicular angle relative to a direction of travel of the fabric pieces on the flow path. A second steam injector array is positioned downstream on the flow path relative to the first steam injector array and proximate an exit of the chamber at a non-perpendicular angle relative to the direction of travel of the fabric pieces on the flow path. As such, the first steam injector array directs a spray of steam impacting a first major surface of the fabric pieces, and the second steam injector array directs a spray of steam impacting a second major surface of the fabric pieces.

According to another preferred embodiment of the invention, the steam injection chamber is substantially rectangular and comprises first and second opposed lateral walls connected to first and second opposed longitudinal walls. The steam injection chamber includes a first steam injector for injecting the fabric pieces with steam positioned at an angle relative to the first lateral wall and the first longitudinal wall.

According to yet another preferred embodiment of the invention, the steam injection chamber includes a second steam injector positioned at an angle relative to the second lateral wall and the second longitudinal wall in substantially diagonal relation to the first steam injector.

According to another preferred embodiment of the invention, the first steam injector is positioned at an angle of about forty-five degrees relative to the first lateral wall and the first longitudinal wall, and the second steam injector is positioned at an angle of about forty-five degrees relative to the second lateral wall and the second longitudinal wall.

According to another preferred embodiment of the invention, the steam injection chamber further includes a third steam injector positioned proximate the first lateral wall at an angle of about ninety degrees relative to the first lateral wall, and a fourth steam injector positioned proximate the second lateral wall at an angle of about ninety degrees relative to the second lateral wall.

According to yet another preferred embodiment of the invention, a tunnel fabric finishing apparatus includes a steaming module having an entrance for receiving fabric pieces to be conveyed through the apparatus, and a steam injection chamber downstream of the entrance for treating the fabric pieces with steam. A first hot air module communicates with the steaming module for receiving the fabric pieces conveyed therefrom, and the first hot air module includes first and second hot air chambers, and an exit downstream of the second hot air chamber. A second hot air module communicates with the first hot air module for receiving the fabric pieces therefrom, and the second hot air module includes a heating apparatus for heating the fabric pieces, and a U-shaped intermediate hot air chamber downstream from the first hot air chamber and upstream from the second hot air chamber for receiving the fabric pieces from the first hot air chamber and for delivering the fabric pieces to the second hot air chamber.

According to another preferred embodiment of the invention, the first and second hot air modules are separable for receiving therebetween at least one expansion module to provide the fabric finishing apparatus with an extended hot air zone sufficient to permit accelerated flow of the fabric pieces through the finishing apparatus while maintaining sufficient dwell time of the fabric pieces in the finishing apparatus to permit completed finishing at the accelerated rate of flow of the fabric pieces.

According to another preferred embodiment of the invention, the steam injection chamber includes at least one steam injector positioned downstream of the entrance at a non-perpendicular angle relative to at least one wall of the steam injection chamber such that the steam injector directs a spray of steam impacting a major surface of the fabric pieces.

According to another preferred embodiment of the invention, the steaming module includes a first steam injector positioned adjacent the entrance of the steaming module at an angle relative to a wall of the steam injection chamber, and the second steam injector positioned adjacent an exit of the steaming module and an entrance of the first hot air module at an angle relative to a wall of the steam injection chamber.

According to another preferred embodiment of the invention, the steaming module includes an exhaust hood for exhausting moisture-laden air from the steam injection chamber.

According to another preferred embodiment of the invention, at least one of the hot air module includes a blower for circulating hot air through the tunnel.

According to another preferred embodiment of the invention, the first hot air module includes an exhaust hood for exhausting moisture-laden air from the finishing apparatus.

According to another preferred embodiment of the invention, the first and second hot air chambers are positively pressurized to prevent entry of cooler air from the steaming module.

According to yet another preferred embodiment of the invention, a steam injection module for use in a finisher includes a substantially rectangular chamber having first and second opposed lateral sides and first and second opposed longitudinal sides, and a flow path on which fabric pieces move from an upstream position in the chamber to a downstream position in the chamber. A first plurality of steam injectors are positioned for injecting the fabric pieces with steam at an oblique angle relative to a direction of travel of the fabric pieces on the flow path.

According to another preferred embodiment of the invention, the first plurality of steam injectors are positioned at an angle of about forty-five degrees relative to the first lateral wall and the first longitudinal wall, and a second plurality of steam injectors are positioned at an angle of about forty-five degrees relative to the second lateral wall and the second longitudinal wall in substantially diagonal relation to the first plurality of steam injectors. As such, the first plurality of steam injectors direct a spray of steam impacting a first major surface of the fabric pieces, and the second steam injector array directs a spray of steam impacting a second major surface of the fabric pieces. A third plurality of steam injectors is positioned proximate the first lateral wall at an angle of about ninety degrees relative to the first lateral wall, and a fourth plurality of steam injectors are positioned proximate the second lateral wall at an angle of about ninety degrees relative to the second lateral wall.

According to another preferred embodiment of the invention, each of the first and second pluralities of steam injectors include four steam injectors.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF PREFERRED EMBODIMENT AND BEST MODE

Figure 1:
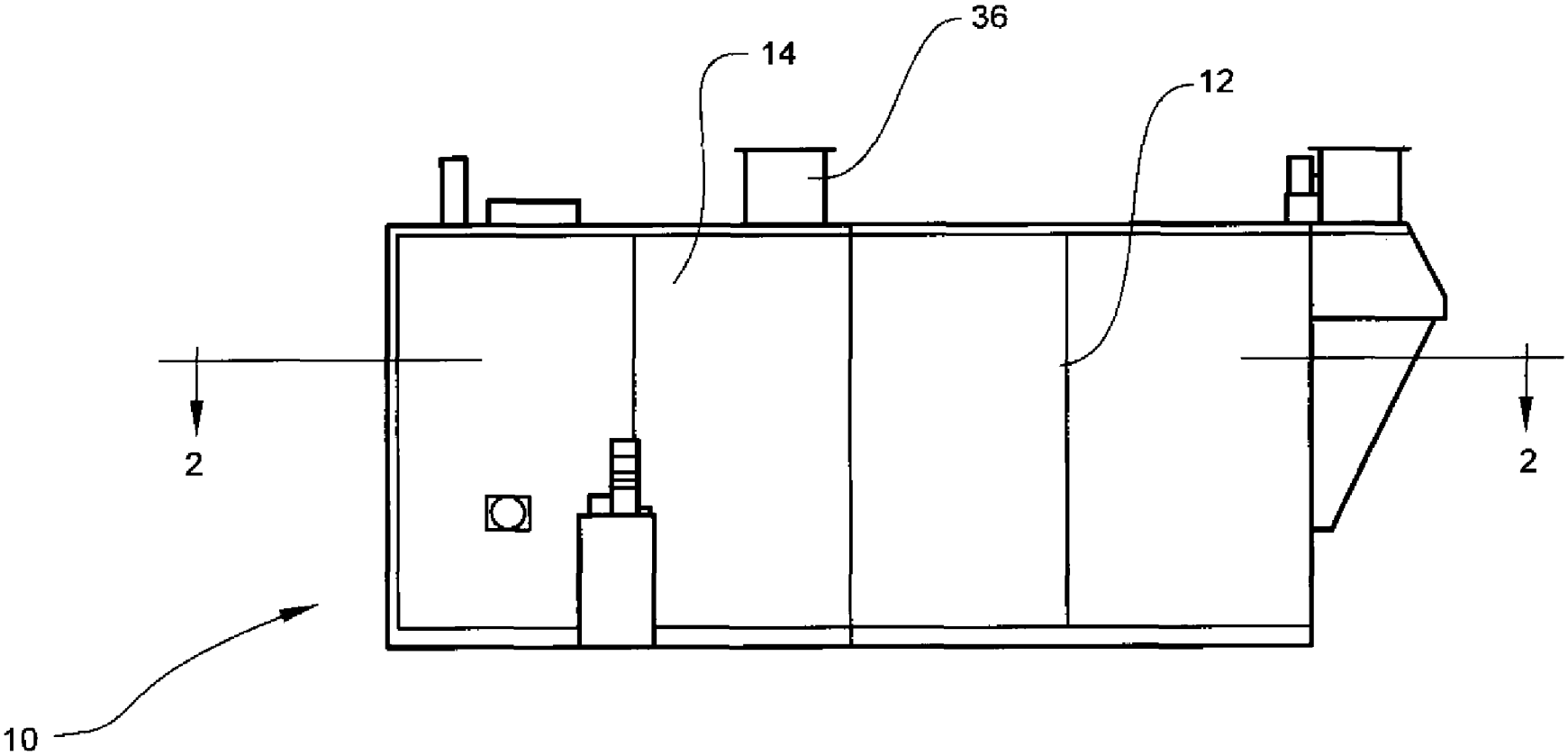
FIG. 1 is a side elevation of a triple pass tunnel finisher according to a preferred embodiment of the invention.
Figure 2:
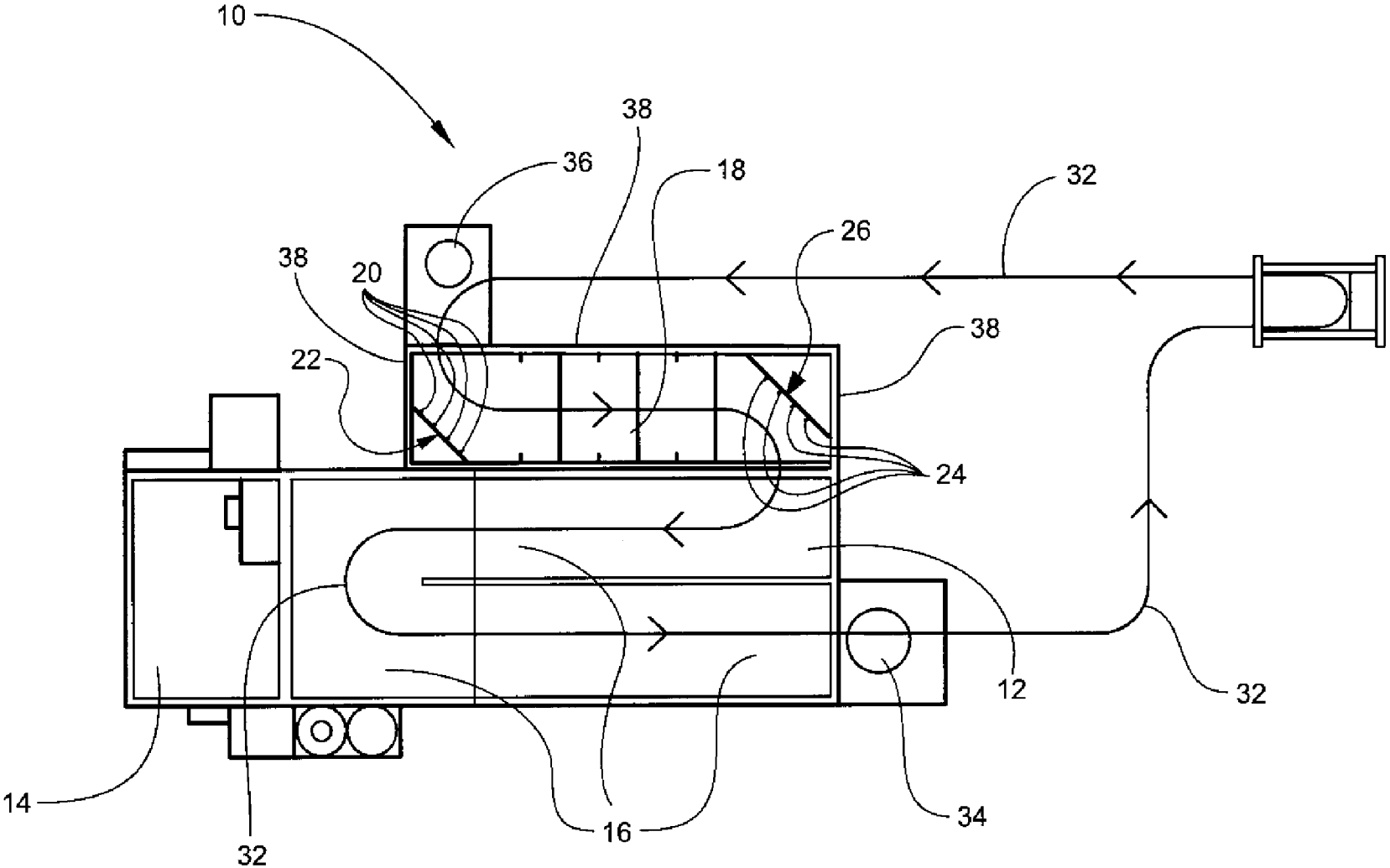
FIG. 2 is a horizontal cross-section of the triple pass tunnel finisher taken through line 2-2 of FIG. 1.

Referring now specifically to the drawings, a triple pass tunnel finisher according to a preferred embodiment of the present invention is illustrated in FIGS. 1 and 2 and is shown generally at reference numeral 10. The triple pass tunnel finisher 10 generally comprises a front module 12, rear module 14 and side steaming module 18. The rear module 14 contains a blower for circulating hot air through the entire tunnel finisher 10, and electric controls for controlling temperature, and a main operator control panel. Alternatively, the front module 12 can house the electric controls, and main operator control panel. As shown in FIG. 2, the front module 12 contains a large portion of the hot air chambers 16, and the rear module 14 also contains a portion of the hot air chambers 16, including the U-turn portion as well as the heat source. The heat source can be a steam heat exchanger, electric heating coils, one or more gas burners, or other suitable heat source. The side steaming module 18 includes the entire steam injection chamber and steam exhaust hood 36, and has a lower pressure than the hot air chambers 16, creating an air pressure differential. As shown in FIG. 1, the finisher 10 can also include an exit exhaust hood 34 for exiting hot gasses generated in the finishing process.

Figure 3:
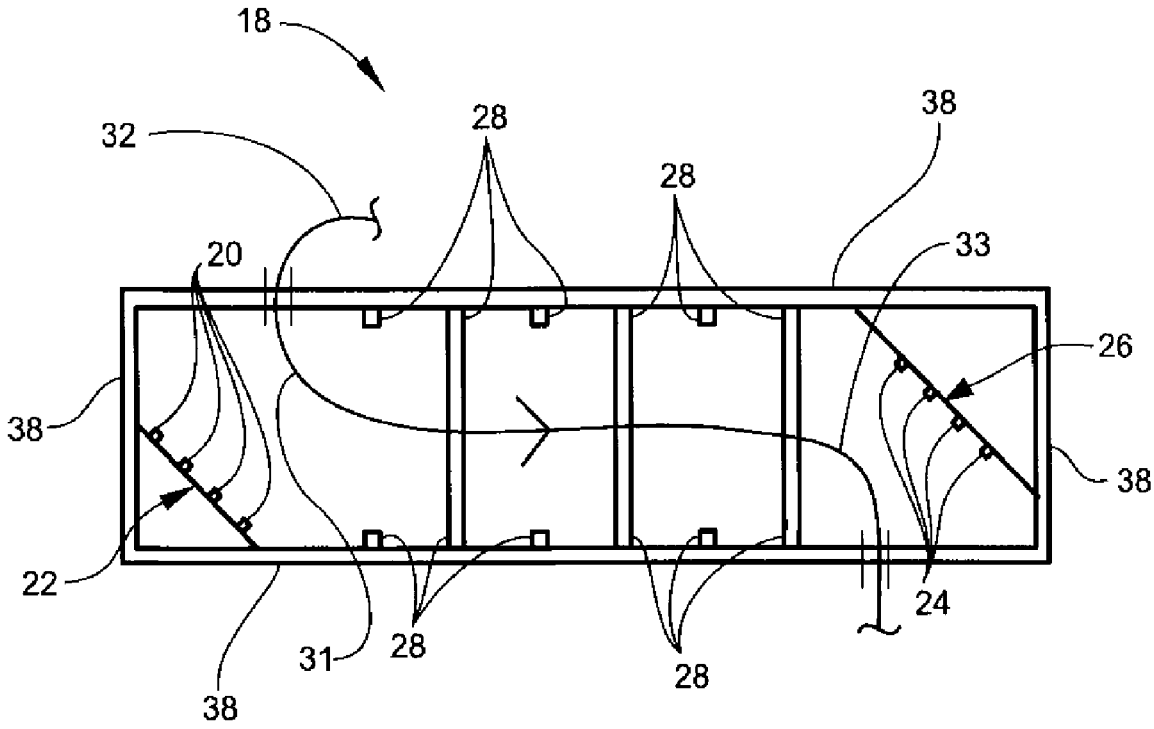
FIG. 3 is a horizontal cross-section of the steam chamber.

As shown in FIG. 2, the side steaming module 18 contains the entrance to the tunnel finisher 10 through which fabric pieces such as garments enter and travel therethrough on a curved flow path 32. The flow path 32 can be a chain conveyor or other suitable conveyance means, and the garments can be carried on hangers by the conveyor through the finisher 10. As the garment enters the side steaming module 18 on the chain conveyer, it travels along the radius of a first curve 31 of the flow path 32, which spreads the garment open as it is immediately injected with steam from steam nozzles 20 positioned on the first steam injection row 22, as shown in FIG. 2. The steam nozzles 20 are preferably positioned at a 45° angle in relation to the walls 38 of the side steaming module 18, as shown in FIGS. 2 and 3. Such positioning allows the steam to thoroughly penetrate the garment, which is particularly beneficial for the laundering of shirts, pants, and jackets.

After traveling along the first curve of the flow path 32, the hangers on which the garments hang return to their normal operating form as the garment proceeds on a substantially straight portion of the flow path 32 in the steaming module 18. The garment then enters a second curve 33 on the flow path 32 leading to the exit of the side steaming module 18. As the garments travel the radius of the second curve 33 they are again spread open, and exposed to another steam injection from steam nozzles 24 positioned on a second steam injection row 26. The garments then exit the steaming module 18 and make a U-turn entering the higher pressurized hot air chamber 16. Preferably, the second steam injection row 26 is positioned in the steaming module 18 diagonally from the first steam injection row 22, as shown in FIGS. 2 and 3. In addition, the steam nozzles 24 of the second injection row 22 are preferably positioned at a 45° angle in relation to the walls 38 of the steaming module 18.

The front module 12 includes the hot air chambers 16, with the exception of the single U-turn portion of the hot air chambers 16 that are located in the rear module 14. The hot air chambers 16 include two separate chambers in which air from a hot air plenum is directed down through the moving garments to complete the drying process. The two chamber arrangement allows for even air flow in each chamber, resulting in an increase in the air velocity. In addition, the hot air chambers 16 are positively pressurized to help prevent entry of relatively cooler air of the steam module 18 from entering the chamber 16. The pressurization also minimizes the amount of cool air that is drafted into the steam module 18 from outside of the finisher 10. This prevents heat loss, allowing the finisher 10 to be more efficient, while increasing the temperature at which the garments exit the steaming module 18 from about 71.1° C. (160° F.), as is typical in conventional finishers, to about 93.3° C. (200° F.). This increase in temperature also enables faster drying times and less garment wrinkling, resulting in reduced dwell time for a garment with a high quality appearance.

The improved steaming module 18 is shown in FIG. 3. The steam module 18 includes the lateral steam injectors 28 located along the chamber walls 38. As shown in FIG. 3, alternate lateral steam injectors 28 can extend across the floor of the steam module 18, and direct steam upward to garments traveling along the flow path 32. The steam module 18 also includes the first steam injection row 22 and the second steam injection row 26, facing the entrance and exit of the steam module 18, respectively. These steam injection rows 22, 26 are each preferably positioned at a 45° angle in relation to the chamber walls. Preferably, four steam nozzles 20, 24 are located along each steam injection row 22, 26, although the number of steam nozzles 20, 24 can be varied. The steam nozzles 20, 24 direct a spray of steam substantially perpendicular to the steam injection rows 22, 26. The arrangement of the steam injection rows 22, 26 allows the steam to fully penetrate the garment in combination with the hanger spreading the garment open, as the hanger enters and exits the steam module 18.

Figure 4:
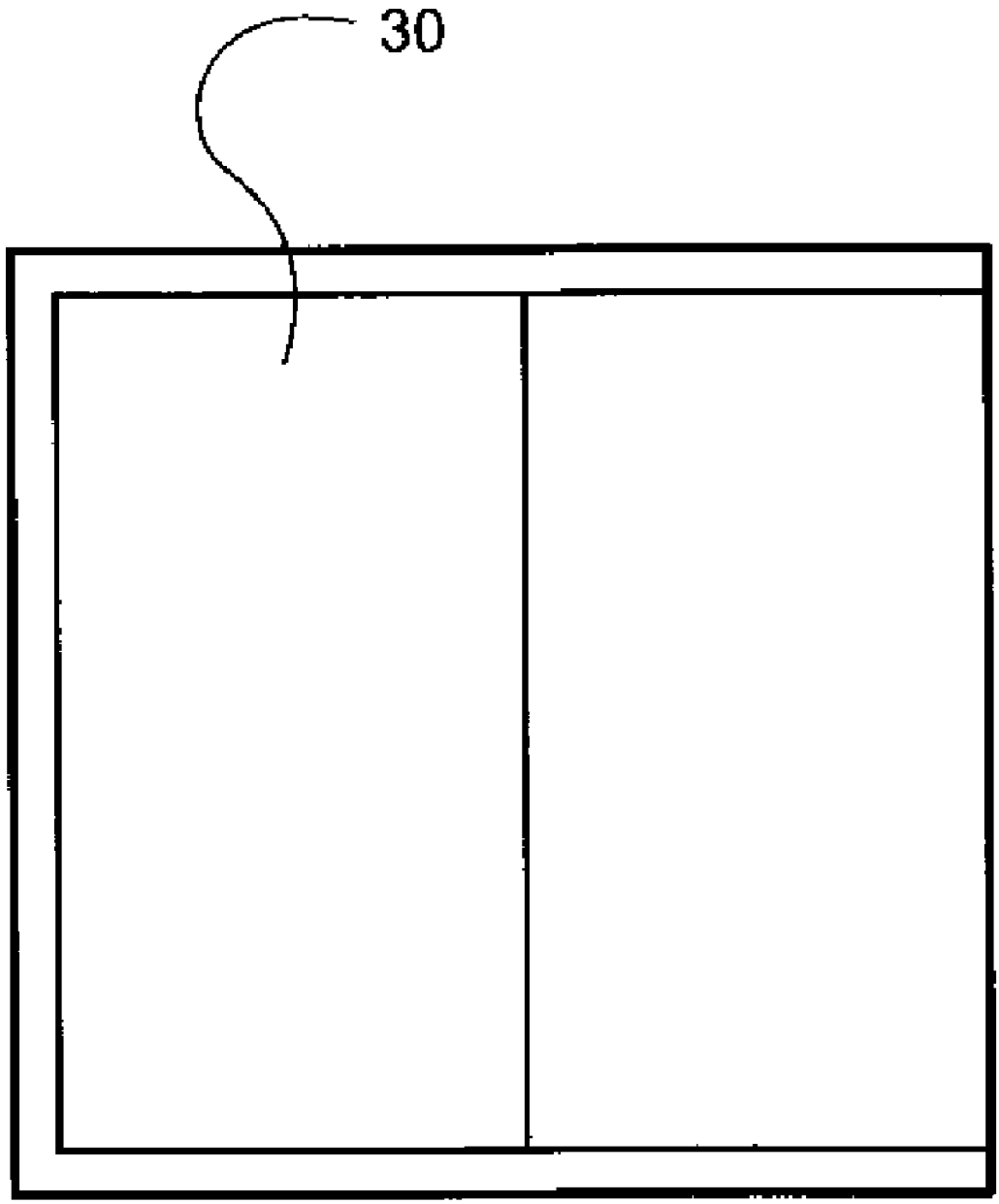
FIG. 4 is a side view of the expansion module.
Figure 5:
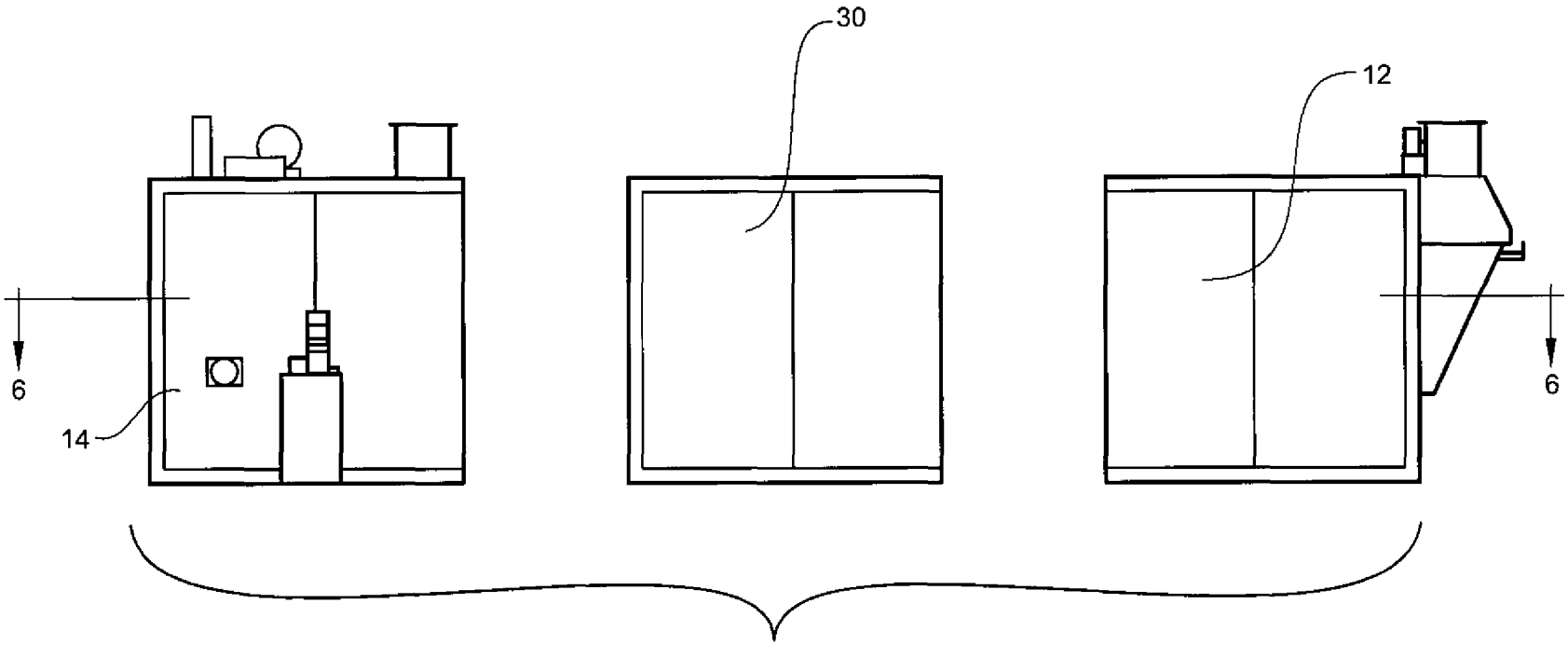
FIG. 5 is a side elevation of a triple pass tunnel finisher with a single expansion module according to the preferred embodiment.
Figure 6:
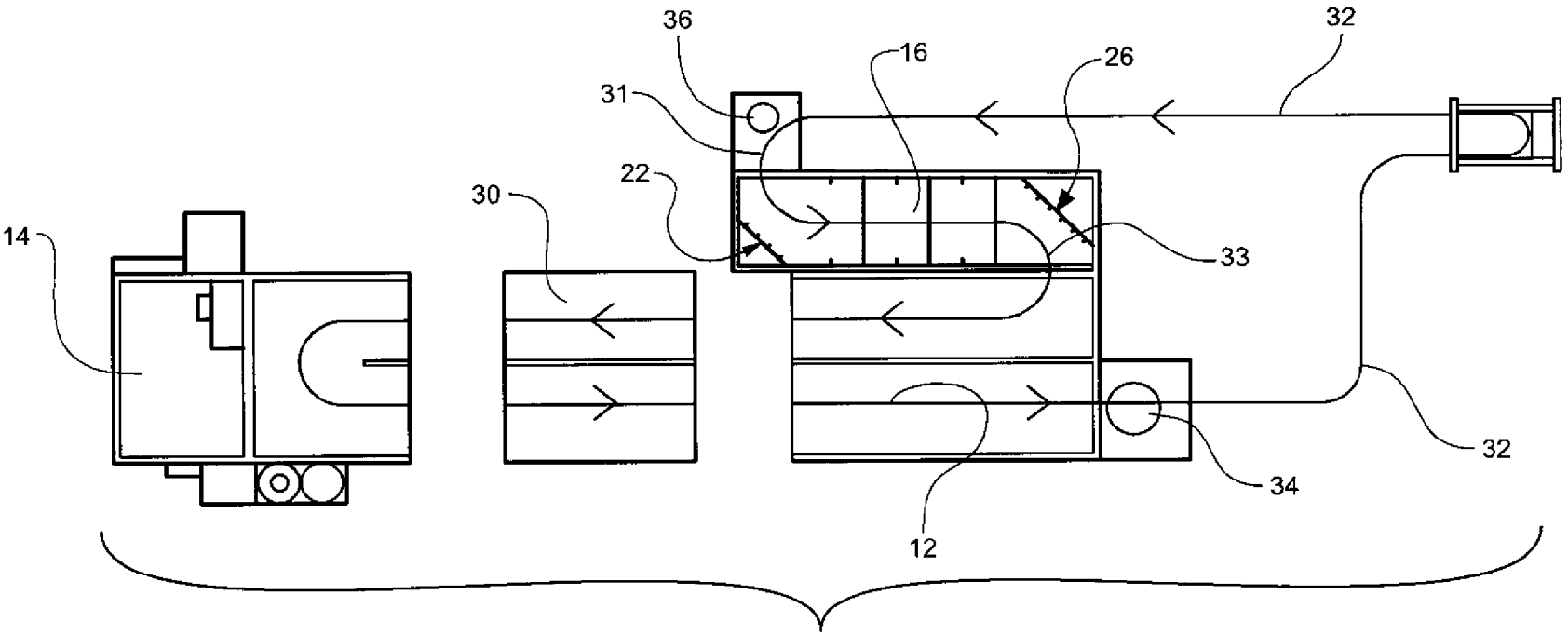
FIG. 6 is a horizontal cross-section of the triple pass tunnel finisher with a single expansion module according to the preferred embodiment taken through line 6-6 of FIG. 5.

The front module 12, rear module 14, side steaming module 18, and steam injection rows 22, 26 collectively comprise an entire functioning finisher 10, and so long as production capacity is met, need not be changed. However, an increase in production can be easily and inexpensively met by unbolting the modules 12, 14, 18 from each other, spreading them apart, and inserting, between the front module 12 and rear module 14, an expansion module 30, shown in FIGS. 4, 5, and 6. The expansion module 30 may contain only an airflow plenum needed to direct heated air onto the garments, and does not decrease the pressure differential between the steaming module 18 and hot air chambers 16. The conveyor chain and piping are lengthened to accommodate the new, longer length, and the system is complete. The simple construction of the expansion module 30, and the lack of need for other functional components, provides a very inexpensive way of increasing production. There is no need for additional electronics, heating capacity, or blowers. Furthermore, the expansion modules 30 may be manufactured in various lengths according to customer specifications.

A high efficiency triple pass tunnel finisher with an articulated spraying function is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

What is claimed is:

1. A triple pass tunnel fabric finishing apparatus comprising:

a conveyor having a serpentine conveyor path;

a first, a second, and a third linear tunnel arranged in a continuous, side-by-side manner enclosing a portion of the serpentine conveyor path, the conveyor path including a first U-turn at an entrance to the first tunnel, a second U-turn at an exit of the first tunnel and an entrance of the second tunnel, and a third U-turn at an exit of the second tunnel and an entrance of the third tunnel, wherein said U-turns provide curved pathway;

a first steam nozzle disposed in the first linear tunnel positioned adjacent an outer curve of the first U-turn;

a second steam nozzle disposed in the first linear tunnel positioned adjacent an outer curve of the second U-turn; and at least one hot air chamber disposed in at least one of the second and third linear tunnels.

2. A tunnel fabric finishing apparatus according to claim 1, wherein the at least one hot air chamber comprises first and second hot air chambers adapted for providing substantially equal air flow in each of the chambers.

3. A tunnel fabric finishing apparatus according to claim 1, wherein the first and second steam nozzles are directed at non-perpendicular angles relative to the conveyor path.

4. A tunnel fabric finishing apparatus according to claim 3, wherein each of the first and second steam nozzles are positioned at an angle of about forty-five degrees relative to at least one wall of the first tunnel.

5. A tunnel fabric finishing apparatus according to claim 1, wherein positive pressurization of the at least one hot air chamber minimizes entry of air from outside of the finisher into the first tunnel.

6. A tunnel fabric finishing apparatus according to claim 1, wherein the first tunnel includes an exhaust hood for exhausting moisture-laden air.

7. A tunnel fabric finishing apparatus according to claim 1, wherein at least one of the second and third tunnels include a blower for circulating hot air through the tunnels.

8. A tunnel fabric finishing apparatus according to claim 1, wherein at least one the second and third tunnels include an exhaust hood for exhausting moisture-laden air from the finishing apparatus.

9. A tunnel fabric finishing apparatus according to claim 1, wherein the first and second tunnels are positively pressurized whereby entry of cooler air from outside of the finisher into the first tunnel is minimized and entry of cooler air from the first tunnel into the second and third tunnels is minimized.

* * * * *